US005292427A

United States Patent [19]

McVicker et al.

[11] Patent Number: 5,292,427

[45] Date of Patent: Mar. 8, 1994

[54] STAGED-ACIDITY REFORMING (C-2705)

[75] Inventors: Gary B. McVicker, Califon; John J. Ziemiak, Annandale, both of N.J.

[73] Assignee: Exxon Research & Engineering Co., Florham Park, N.J.

[21] Appl. No.: 992,230

[22] Filed: Dec. 17, 1992

[51] Int. Cl.[5] ..... C10G 35/085; C10G 59/02

[52] U.S. Cl. ..... 208/139; 208/138; 208/64; 208/65

[58] Field of Search ..... 208/139, 138, 65, 64

[56] References Cited

U.S. PATENT DOCUMENTS 3,953,368 4/1976 Sinfelt ..... 502/223
3,963,601 6/1976 Hilfman ..... 208/111
4,167,473 9/1979 Sikonia ..... 208/139
4,174,270 11/1979 Mayes ..... 208/64
4,201,661 5/1980 Juguin et al. ..... 208/139
4,472,529 9/1984 Johnson et al. ..... 502/228

*Primary Examiner*—R. Bruce Breneman
*Assistant Examiner*—Lorna M. Douyon
*Attorney, Agent, or Firm*—Estelle C. Baker

[57] ABSTRACT

Staged-Acidity Naphtha Reforming provides increased $C_{5+}$ liquid yields by systematically adjusting catalyst acidity within a multireactor reformer to match the different acid strengths required to selectively aromatize naphthene and paraffin hydrocarbon as they traverse the reformer train.

6 Claims, 4 Drawing Sheets

STAGED-ACIDITY REFORMING (C-2705)

BACKGROUND

The reforming of petroleum naphthas is carried out over catalysts which consist of a metal or metals dispersed on an acidic support such as alumina or silica-alumina. Such catalysts, possessing both metal and acid functionalities, simultaneously promote metal and acid catalyzed conversions of saturated hydrocarbons. Major reactions promoted by bifunctional catalysts are hydrogenation, dehydrogenation, isomerization, cyclization, hydrocracking and hydrogenolysis. The goal in the reformer is to maximize aromatics production at the expense of light gas make. Naphthenic molecules (alkylcyclopentanes and alkylcyclohexanes) are readily converted to aromatics, by a combination of isomerization and dehydrogenation reactions, within the first 10–40% of the total reformer train (a reformer train normally contains 3 to 4 reactors in series). The naphthene to aromatic transformation typically occurs with high (80–95%) selectivity. $C_{6+}$ paraffinic molecules, in contrast, are more difficult to aromatize. Their conversion continues throughout the entire reformer train. Under similar reaction conditions, the generation of aromatic molecules via the dehydrocyclization of paraffins containing six or more carbon atoms is much less (15–60%) selective than naphthene aromatization. The lower selectivities found for paraffin dehydrocyclization result primarily from competitive hydrogenolysis and hydrocracking reactions. What is needed in the art is a reforming process catalyst capable of substantially improving the yield of aromatic molecules obtained from naphthenic and paraffinic hydrocarbons and mixtures of such hydrocarbons.

SUMMARY OF THE INVENTION

The present invention is directed to a staged-acidity reforming process for the increased production of aromatic reformates comprising contacting a naphtha feed in a plurality of sequentially arranged reaction zones each containing a bifunctional reforming catalyst, and wherein said reforming catalyst of the initial reaction zone has a relative acidity at least about 2 to 50 fold greater than the catalysts in subsequent reaction zones. In the preferred embodiment the catalyst of the initial reaction zone will comprise a fluorided-platinum-/iridium on alumina reforming catalyst.

BRIEF DESCRIPTION OF THE DRAWINGS

FIG. 1 shows Conversion (wt %)=(wt % MCP+wt % $nC_7$ in the product) on the Y-axis designated as % C and time in hours on the X-axis. The results show that over the 120 hour run the total conversion of the feedstock over the two different reforming systems was essentially the same.

FIG. 2 shows weight percent aromatics (% A)=(wt % benzene+wt % toluene) in the product on the Y-axis and time in hours on the X-axis. FIG. 2 shows that over the 120 hour run, described above, the staged-acidity reforming system (A) of the present invention exhibited a 5–6 wt % higher time average aromatics yield than the constant-acidity system (B). Since the conversion level of the two catalyst systems is the same, the 5–6 wt % higher aromatics yield demonstrated by the staged-acidity system is highly significant.

FIG. 3 shows the selectivity ratio S=(wt % benzene+wt % toluene)/wt % ($C_1$–$C_6$) on the Y-axis and time in hours on the X-axis for the 120 hour reforming run described above. The selectivity of the staged-acidity system (A) is substantially higher. This selectivity benefit results primarily from the staged-acidity system converting methylcyclopentane more selectively (less cracking to $C_1$–$C_6$ molecules and increased aromatization to benzene) than the constant-acidity system (B).

FIG. 4 shows that the system of the present invention (A) is substantially more selective and preferable to system (B).

DETAILED DESCRIPTION OF THE INVENTION

Figure 1:
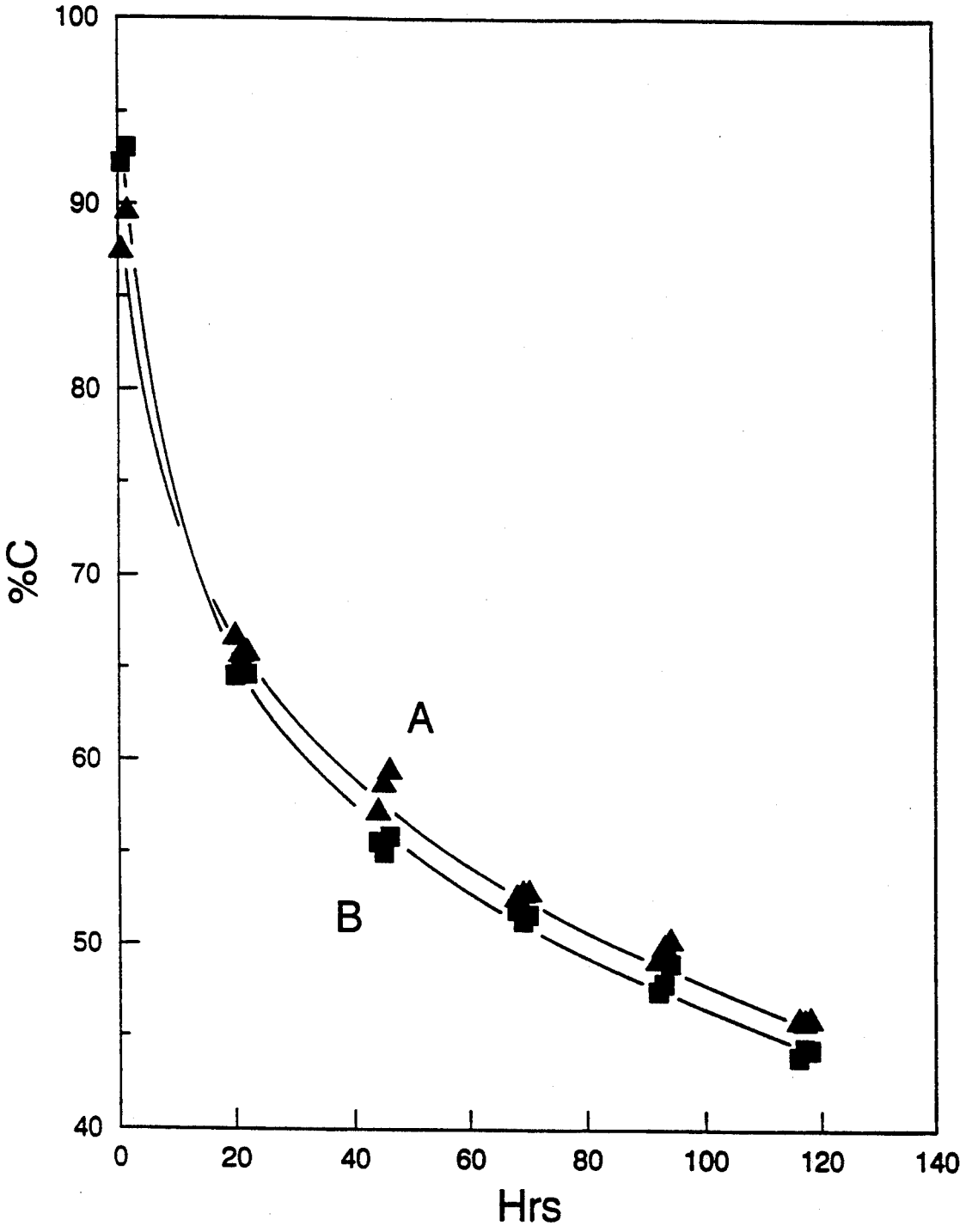
FIGS. 1, 2, and 3 compare a staged-acidity reforming process A to a constant-acidity reforming process B. The staged-acidity reforming process (A) was conducted using a fluorided-platinum/iridium on alumina catalyst (0.3% Pt/0.3% Ir/0.6% Cl/0.9% F) in zone 1 and the conventional chlorided-platinum/iridium reforming catalyst of the constant-acidity process in zone 2 (0.3% Pt/0.3% Ir/0.9% Cl) in a 1:1 ratio. The constant-acidity reforming process (B) was conducted using the conventional chlorided-platinum/iridium catalyst in both zones 1 and 2 in a 1:1 ratio. The systems were run using a methylcyclopentane (MCP)/n-heptane ($nC_7$) [50/50 by weight] mixture and 0.5 WPPM sulfur feed at 485° C., 14.6 atmospheres total pressure, WHW=21.5, and $H_2$/Feed=5.0.

The staged-acidity systems of the present invention, employing higher relative catalyst acidities (at least about 2–50 fold greater) in the lead-reactor zone of a series of sequential reactor zones, exhibit enhanced naphtha reforming yields to aromatic molecules because naphthene molecules are more selectively converted in the lead zone and paraffin molecules are more selectively converted in the tail zone to aromatic molecules.

The present invention utilizes a plurality of sequentially arranged reaction zones. The reforming system may be of any type well known to those skilled in the art. For example, the reforming system may be a cyclic, semi-cyclic, or moving bed system. The only requirement for successful operation of the instant invention is that the particular system chosen comprise a plurality of sequentially arranged reaction zones. Moreover, the reaction zones may be housed in individual reactor vessels, or may be housed in a single vessel (properly segregated), as would be obvious to those skilled in the art. The reforming operation may be conducted in either isothermal or adiabatic reactor systems. Suitably, the reforming system comprises at least two reaction zones, preferably three or four.

The essence of the instant invention resides in reforming a naphtha feed stock under conditions in which the various reforming reaction zones are regulated by controlling catalyst acidity within multireaction zones to match the different acid strengths required to selectively aromatize naphthenes and paraffins as they traverse a plurality of sequential reaction zones. Applicants have found that by reforming the naphtha feed in a multiple reaction zone reforming system, in which the first reaction zone (5–50% of total catalyst charge) contains a catalyst having a relative acidity at least about 2–50, preferably 25–40, times higher than the catalysts employed in subsequent reaction zones, paraffins and naphthenes are more selectively converted to aromatic hydrocarbons. The resultant reformate obtained by the present invention is not obtainable with conventional reforming processes since reforming catalysts conventionally used therein produce a significant amount of light cracked products from the naphthene molecules in the first reaction zone.

Although any conventional catalysts can be used in the present invention as long as the relative acidity of the catalyst in the first reaction zone is at least about 2–50 fold higher than that of the catalysts in subsequent reaction zones, in a particularly preferred embodiment, a fluorided-platinum/iridium catalyst will be employed in the first reaction zone of the instant invention and conventional reforming catalysts in all subsequent reaction zones. This particular catalyst affords a significant acidity increase over conventional reforming catalysts providing for increased aromatics production and low cracking from naphthene molecules in the lead reaction zone. The relative acidity increase over conventional chlorided-platinum, chlorided-platinum/iridium, and chlorided-platinum/rhenium catalysts is about 30 to 50, and will be readily evident from the examples.

Hence in the preferred embodiment the first reaction zone will contain a fluorided-platinum/iridium catalyst comprising 0.1–10 wt. % fluorine, preferably 0.3–1.5 wt. % fluorine and most preferably about 0.8–1.2 wt. % fluorine. The amounts of platinum and iridium will each range from about 0.01 to about 10 wt. %, preferably about 0.1 to 0.6 and most preferably about 0.3 wt. %. The catalyst may further contain an amount of chlorine from about 0.0 to about 1.5 wt. %. Typically chlorine results from catalyst preparation using chloroplatinic and chloroiridic acid metal precursors, however, it is not a necessary component of the initial reaction zone catalyst composition. The catalyst support can be any of a number of well-known inorganic oxides, however alumina is preferred.

The fluorided-platinum/iridium (F/Pt/Ir) catalyst may be prepared by any technique well-known to those skilled in the art.

The catalysts employed in the reaction zones following the first reaction zone are conventional reforming catalysts. These types of catalysts are well-known to those skilled in the art as are the techniques for preparing them and any such suitable catalyst may be utilized in the instant invention. Alternatively, the catalysts are commercially available. Examples of such catalysts are platinum, platinum/tin, platinum/rhenium, and platinum/iridium catalysts, however any other conventional reforming catalysts may also be used excluding another catalyst having a relative acidity equal to or higher than the relative acidity of the catalyst in the initial reaction zone, e.g., a highly acidic F/Pt/Ir catalyst as used in the first reaction zone. Highly acidic means a relative acidity 2–50 fold greater than catalysts in subsequent reaction zones.

In addition to employing a F-Pt/Ir catalyst in the initial reaction zone, other highly acidic catalysts may also be employed. For example an alumina supported Group VIII noble metal can be employed. In such a case, the surface area of the alumina can be adjusted from high surface area in the initial reaction zone to lower surface areas in subsequent reaction zones thereby systematically varying the amount of halide (e.g. chloride and/or fluoride) which can be maintained on the catalyst, hence controlling its acidity. The higher surface area halided-aluminas would be more acidic and therefore usable in the initial reaction zone. Such acidity adjustments are easily carried out by one skilled in the art without undue experimentation. Alternatively, a Group VIII noble metal containing silica-alumina catalyst could be used in the initial reaction zone.

In a naphtha reforming process, a substantially sulfur-free naphtha stream (less than 10 ppm sulfur) that typically contains about 20–80 volume % paraffins, 20–80 volume % naphthenes, and about 5 to 20% aromatics and boiling at atmospheric pressure substantially between about 25° and 235° C., preferably between about 65° and 190° C., is brought into contact with the catalyst system of the present invention in the presence of hydrogen. The reactions typically take place in the vapor phase at a temperature varying from about 345° to 540° C., preferably about 400° to 520° C. Reaction zone pressures may vary from about 1 to 50 atmospheres, preferably from about 5 to 25 atmospheres.

The naphtha feedstream is generally passed over the catalyst at space velocities varying from about 0.5 to 20 parts by weight of naphtha per hour per part by weight of catalyst (W/H/W), preferably from about 1 to 10 W/H/W. The hydrogen to hydrocarbon mole ratio within the reaction zone is maintained between about 0.5 and 20, preferably between about 1 and 10. During the reforming process, the hydrogen employed can be in admixture with light gaseous ($C_1$–$C_4$) hydrocarbons. Since the reforming process produces large quantities of hydrogen, a recycle stream is typically employed for readmission of hydrogen to the naphtha feedstream.

In a typical operation, the catalyst is maintained as a fixed-bed within a series of adiabatically operated reactors. Specifically, the product stream from each reactor (except the last in the reactor series) is reheated prior to passage to the following reactor.

A naphtha reforming operation involves a number of reactions that occur simultaneously. Specifically, the naphthene portion of the naphtha stream is dehydrogenated and/or dehydroisomerized to the corresponding aromatic compounds, the paraffins are isomerized to branched chain paraffins, and dehydrocyclized to various aromatics compounds. Components in the naphtha stream can also be hydrocracked to lower boiling components. Utilizing a highly acidic catalyst, e.g., the fluorided-platinum/iridium catalyst, in the first reaction zone of the instant process has been found to be particularly selective in converting naphthenes to aromatics. The process affords about a 2–20 wt. % increase in aromatic yields.

The following examples are illustrative of the invention and are not limiting in any way.

Examples

Catalysts

The monometallic and bimetallic catalysts employed in the following comparisons were supported on $\gamma$-$Al_2O_3$ carriers. The $\gamma$-$Al_2O_3$ carriers exhibited BET surface areas in the range of 180–190 $m^2/gm$ and are indistinguishable by x-ray diffraction measurements.

A 0.3% Pt catalyst (hereafter designated as (Pt)) was obtained commercially. The catalyst contained 0.6% chlorine. Before use the catalyst was calcined at 500° C. under 20% $O_2$/He (500 $cm^3$/min) for 4.0 hrs.

A platinum and rhenium bimetallic catalyst (hereafter designated as (Pt/Re)) was obtained commercially. The composition of the catalyst is 0.3 wt. % platinum, 0.3 wt. % rhenium and 0.9 wt. % chlorine. Prior to use the catalyst was calcined at 510° C. under 20% $O_2$/He (500 $cm^3$/min) for 3.0 hrs.

A platinum and iridium bimetallic catalyst (hereafter designated at (Pt/Ir) was obtained commercially. The composition of the catalyst is 0.3 wt. % platinum, 0.3 wt. % iridium and 0.9 wt. % chlorine. Prior to use the catalyst was mildly calcined at 270° C. under dry air for 4.0 hrs.

Standard hydrogen chemisorption and electron microscopy measurements indicate that the metallic phases present in the above mono and bimetallic reforming catalysts are essentially completely dispersed and directly accessible by hydrocarbon molecules.

On occasion halide adjustments to the above catalysts were made by the use of standardized aqueous HCl and HF solutions as noted.

Catalytic Conversions

Hydrocarbon conversion reactions were carried out in a 25 $cm^3$, stainless steel, fixed-bed, isothermal hydrotreating unit operated in a single pass mode. The reactor was heated by a fluidized sand bath. Hydrogen was passed through Deoxo and molecular sieve drying units prior to use. Feed was delivered by a dual barrel Ruska pump which allowed continuous operation.

Methylcyclopentane aromatization experiments were carried out at 475° C. under 14.6 atm total pressure. A space velocity of 40 WHW was used and the hydrogen/methylcyclopentane mole ratio was held at 5.0. Catalysts were reduced in situ under 14.6 atm hydrogen (1100 $cm^3$/min) at 500° C. for 2.0 hrs. The reduced catalysts were subsequently sulfided in place at atmospheric pressure using a 0.5% $H_2S/H_2$ mixture (200 $cm^3$/min) at the pre-selected reaction temperature. Sulfiding was continued until breakthrough $H_2S$ was detected. Feed was introduced at the reaction temperature to minimize sulfur loss from the catalyst. Feed sulfur level adjustments were made by the addition of standardized thiophene solutions. Reaction products (methane through benzene) were analyzed by in-line G.C. measurements. The product train was equipped with a gas phase sparger to ensure complete product homogenization. A 30 ft. by ⅛ inch (o.d.) column packed with 20% SP-2100 on a ceramic support provided good product separation. n-Heptane dehydrocyclization experiments were carried out at 495° C. under 14.6 atm. total pressure. Catalysts were reduced in situ at 500° C. under 14.6 atm hydrogen (1100 $cm^3$/min) for 2.0 to 16 hrs. Pre-reduced catalysts were sulfided with 0.5% $H_2S/H_2$ (300 $cm^3$/min) to breakthrough at 370° C. and atmospheric pressure. n-Heptane sulfur levels were adjusted by the addition of standardized thiophene solutions. Feed was introduced at 400° C. and was maintained at this temperature for 16 hrs. Over a period of 8.0 hrs. the reaction temperature was increased to the desired setting. This start-up procedure provided reproducible catalyst reaction patterns. A space velocity of 21 WHW was employed. The hydrogen/n-heptane mole ratio was maintained at 5.0. Direct analysis of reaction products (methane through the isomeric xylenes) were made by in-line G.C. measurements.

Staged-Acidity Reforming

Standard experimental procedures including the staged-bed configuration, run conditions and feed composition used in staged-acidity simulations are 485° C., 14.6 atmospheres total pressure, WHW=21.5, $H_2$/Feed=5.0, feed=methylcyclopentane/$nC_7$ (50/50 by weight) and 0.5 WPPM sulfur. Catalyst zones 1 and 2 each contained 0.5 gm of catalyst admixed with inert mullite beads to provide a volume of 5 $cm^3$ in each zone. Catalyst zones 1 and 2 are separated by a 5 $cm^3$ zone containing only inert mullite beads. Space velocity (WHW) is based upon the total (1.0 gm) catalyst charge.

Acidity Measurements

The relative acidities of halided reforming catalyst were established using the isomerization of 2-methylpent-2-ene as an acidity probe [Kramer and McVicker, Accounts of Chemical Research, 19, 78 (1986).]. 2-methylpent-2-ene isomerization tests were conducted by flowing a helium stream containing 7 mole % olefin (161 $cm^3$)/min) at 1.0 atm pressure over 1.0 gm of catalyst in a 22 $cm^3$ stainless steel reactor held at 250° C. Catalysts were pretreated in flowing helium for 1.0 hr at 500° C. Relative rates of conversion of 2-methylpent-2-ene to isomers requiring skeletal rearrangement (e.g., 3-methylpent-2-ene) of the carbon framework as opposed to those obtained by 1,2-hydride shifts (e.g., 4-methylpent-2-ene) were used to define a relative acidity scale.

Results and Description of Invention

As summarized in Table 1, increasing the chloride ion concentration of a (Pt) catalyst from 0.6 to 0.9 wt. % increased the relative acidity of the catalyst by a factor of 1.6. At conventional reforming catalyst chloride ion concentrations of 0.9 wt. % monometallic (Pt), as well as, bimetallic (Pt/Re) and (Pt/Ir) catalysts display similar acidity levels. Addition of 0.9 wt. % fluoride to the (Pt/Ir) catalyst increased the acidity by a factor of 30 over conventional monometallic Pt and bimetallic (Pt/Re) and (Pt/Ir) reforming catalyst containing 0.9% Cl. Thus fluoride ion is a substantially more potent acidity promoter than chloride ion.

TABLE 1

ACIDITY FUNCTION STUDIES - THE SELECTIVITIES OF Pt/Ir CATALYSTS ARE DEPENDENT UPON SUPPORT ACIDITY[A]

| | | | | METHYLCYCLOPENTANE | | | HEPTANE | | |
|---|---|---|---|---|---|---|---|---|---|
| | WT. % | | RELATIVE[C] | CONV. RATES[D] | | | CONV. RATES[D] | | |
| CATALYST[B] | Cl | F | ACIDITY | BENZENE | CRACKING | A/C[E] | TOLUENE | CRACKING | A/C[E] |
| 0.3% Pt | 0.6 | — | 1.0 | 5.7 | 1.8 | 3.2 | 1.5 | 2.5 | 0.60 |
| 0.3% Pt | 0.9 | — | 1.6 | 6.1 | 1.9 | 3.2 | 2.2 | 3.3 | 0.67 |
| 0.3% Pt/0.3% Re | 0.9 | — | 1.8 | 7.2 | 2.2 | 3.3 | 2.9 | 4.5 | 0.64 |
| 0.3% Pt/0.3% Ir | 0.9 | — | 1.8 | 6.7 | 8.8 | 0.76 | 4.1 | 3.5 | 1.17 |

TABLE 1-continued

ACIDITY FUNCTION STUDIES - THE SELECTIVITIES OF Pt/Ir CATALYSTS ARE DEPENDENT UPON SUPPORT ACIDITY[A]

| CATALYST[B] | WT. % Cl | WT. % F | RELATIVE[C] ACIDITY | METHYLCYCLOPENTANE CONV. RATES[D] BENZENE | CRACKING | A/C[E] | HEPTANE CONV. RATES[D] TOLUENE | CRACKING | A/C[E] |
|---|---|---|---|---|---|---|---|---|---|
| 0.3% Pt/0.3% Ir | 0.6 | 0.9 | 55 | 11.0 | 3.4 | 3.2 | 3.0 | 8.8 | 0.34 |

[A]475° C.(MCP), 495° C.($C_7$); 14.6 atm; $H_2$/Feed = 5; WHW = 40(MCP), 21($C_7$); 1.0 ppm sulfur, 24 hr on feed
[B]γ-Alumina Supports, 190 $m^2$/gm
[C]Relative Acidities Determined By 2-Methylpent-2-ene Isomerization
[D]Rates = Mole/Hr/Gm × $10^2$
[E]Ratio of Aromatization/Cracking Rates The reaction profiles of methylcyclopentane and n-heptane clearly reflect significant acidity differences between chlorided-and fluorided-(Pt/Ir) catalysts (see Table 1). The high methylcyclopentane cracking activity shown by Pt/Ir/0.9% Cl (four times that of (Pt) and (Pt/Re)) indicates that the acidity level of (Pt/Ir) is not optimum for this particular hydrocarbon conversion. The high metals activity of (Pt/Ir) must be balanced by a high support acidity. If the acid catalyzed interconversion of five and six membered ring olefins is not rapid, methylcyclopentane, as well as, intermediate cyclic olefins will be extensively hydrocracked to light gases. Higher acidities were anticipated to improve the selectivity of (Pt/Ir) by increasing the rate of aromatization at the expense of cracking. Upon fluoride addition the rate of benzene formation over (Pt/Ir) was dramatically increased. Concomitantly the rate of cracking decreased with increasing acidity. This behavior suggests that the acidity function is limiting the rate of aromatization of methylcyclopentane over (Pt/Ir) catalysts. In contrast, raising the acidity of (Pt) by increasing chloride concentration from 0.6 to 0.9 wt. % did not markedly alter its aromatization and cracking rates. The relative insensitivity of the (Pt) catalyst to changes in support acidity indicates that low metal site activity and not acid site activity is controlling the overall conversion pattern of this catalyst. At the highest support acidity investigated (0.6% Cl, 0.9% F) the selectivity (A/C value) displayed by (Pt/Ir) is equivalent to those shown by (Pt) and (Pt/Re). Thus increasing the support acidity of (Pt/Ir) catalysts by the addition of fluoride ion enhances the aromatization rate and decreases the cracking rate which improves the overall selectivity pattern of this catalyst. The addition of fluoride ion would not, however, be expected to significantly increase the aromatization rates and selectivities of (Pt) and (Pt/Re) since the reaction pattern of these catalysts appear to be limited by metal not acid activity.

At conventional chloride ion concentrations of 0.9 wt. % the n-heptane dehydrocyclization rate and A/C selectivity demonstrated by (Pt/Ir) are considerably higher than those shown by either (Pt) or (Pt/Re). Both the dehydrocyclization and cracking rates of (Pt) are increased upon increasing the chloride ion concentration from 0.6 to 0.9 wt. %. The performance of Pt/Ir catalysts was found, however, to be insensitive to changes in chloride concentrations above about 1.0 wt. %. Although individual conversion rates are dependent upon chloride ion concentration, catalyst selectivity (A/C values) are essentially unchanged by changes in support acidities. Thus the major consequences of higher support acidities via chloride ion promotion is to increase the quantity of n-heptane converted. The addition of 0.9 wt. % fluoride to (Pt/Ir) significantly increased the quantity of n-heptane converted. Increased conversion resulted primarily from increased cracking activity which generated excessive amounts of propane and isobutane. These light gas products result from acid site cracking. A similar fluoride (acidic) level greatly improved, as noted above, the selectivity of (Pt/Ir) for methylcyclopentane conversion. The drastic loss in n-heptane conversion selectivity over the same fluoride promoted catalyst indicates that lower support acidities are required for paraffin dehydrocyclization than for naphthene aromatization. Therefore, highly acidic fluoride platinum/iridium should not be used in the tail zones of a reforming train.

Staged-Acidity Reforming

Figure 2:
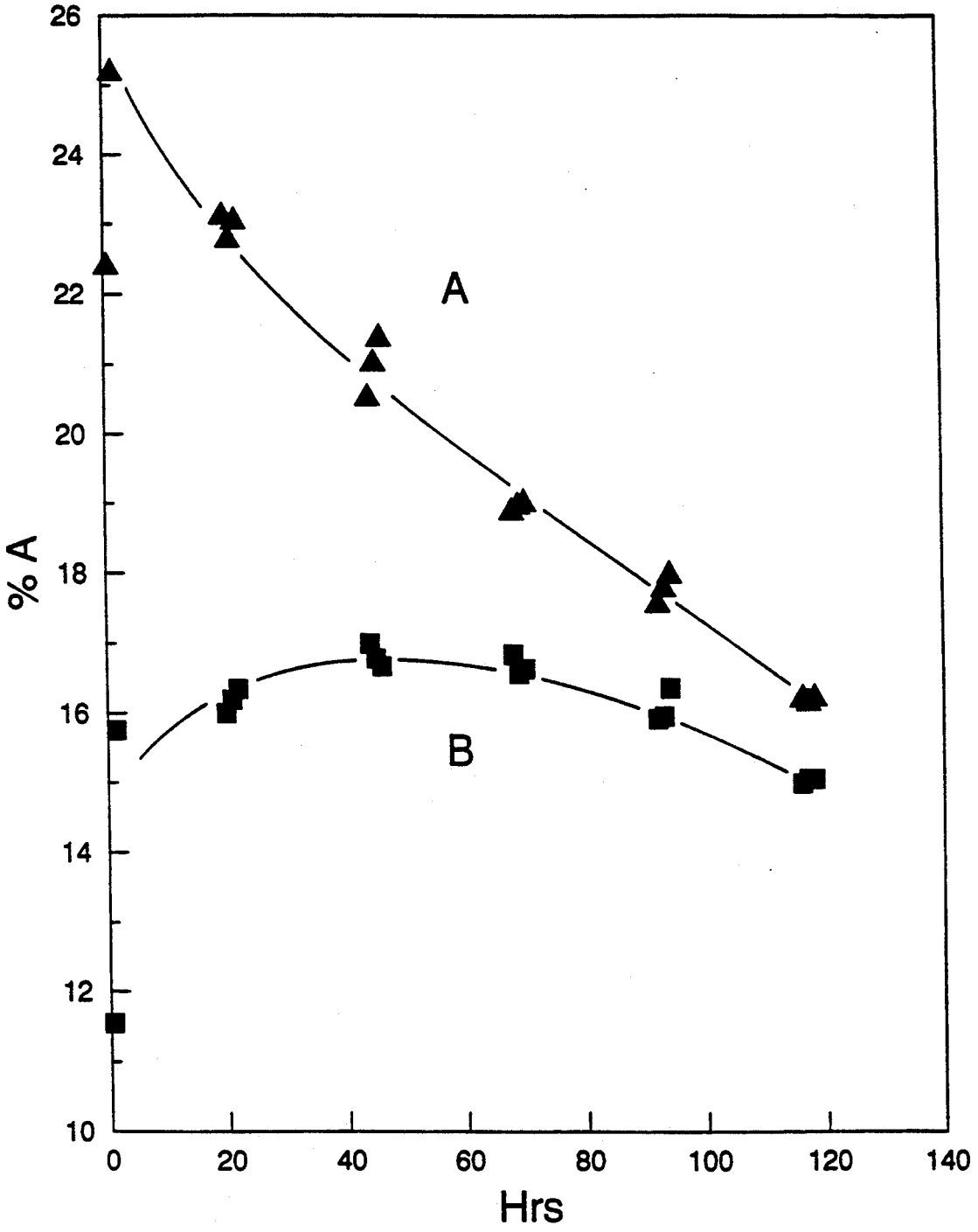
Figure 3:
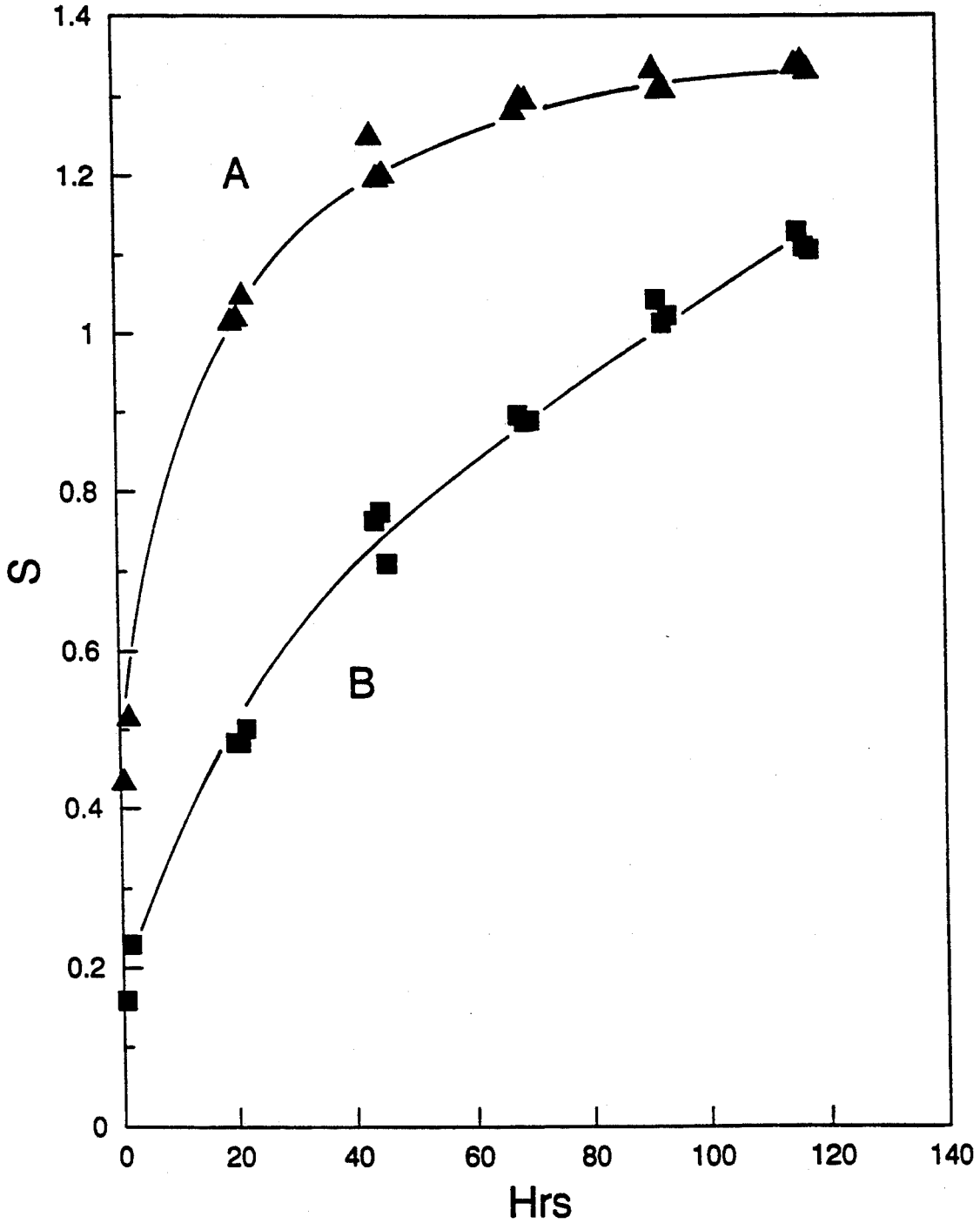

The above model compound studies clearly show that naphthene and paraffin aromatization rates and product selectivities over (Pt/Ir) catalysts are markedly affected by changes in support acidity. In contrast, (Pt) and (Pt/Re) catalysts which have less active metal functions than (Pt/Ir) exhibit weaker responses to acidity changes. Hence, applicants have found that fluorided-(Pt/Ir) in a lead-reactor (stage 1) zone to carry out selective naphthene aromatization followed by conventional chlorided-(Pt/Ir) in a tail-reactor (stage 2) zone to facilitate selective paraffin dehydrocyclization leads to increased aromatics make. FIGS. 1, 2 and 3 compare various catalytic reforming conversion patterns of two different staged systems comprised of:

(i) 0.5 gm of a conventional 0.3% Pt/0.3% Ir/0.9% Cl catalyst in each of the two catalyst zones. This system, designated as (B) represents a constant acidity case, and (ii) 0.5 gm of 0.3% Pt/0.3% Ir/0.6% Cl/0.9% F in zone 1 followed by 0.5 gm of the conventional Pt/Ir/Cl of (i) in zone 2. This system, designated as (A), exemplifies a staged-acidity case. The staged-acidity concept was tested under the reaction conditions outlined in the Staged Acidity Reforming section of the examples.

FIG. 1 shows that throughout the 120 hr life of the test that the total conversion of the mixed methylcyclopentane and n-heptane feedstock was essentially the same over both the staged-conventional system (B) and the staged-acidity system (A) in which the highly acidic fluorided Pt/Ir catalyst was placed in zone 1.

Over the course of the 120 hr test the staged-acidity system (A) containing fluorided-Pt/Ir in the lead reactor position exhibited a 5–6 wt. % higher time average aromatics yield than the constant-acidity system (B) (see FIG. 2). Since the conversion level of the two catalyst systems were the same the 5–6 wt. % higher aromatics yield demonstrated by the staged-acidity system of the instant invention is truly significant.

Staged (Pt/Ir) catalyst systems employing higher catalyst acidities in the lead-reactor position, therefore, would exhibit enhanced naphtha reforming yields since the naphthene and paraffin molecules present in the naphtha feedstock would be more selectively converted to aromatics in the lead-and-tail-reactor zones, respectively.

Figure 4:
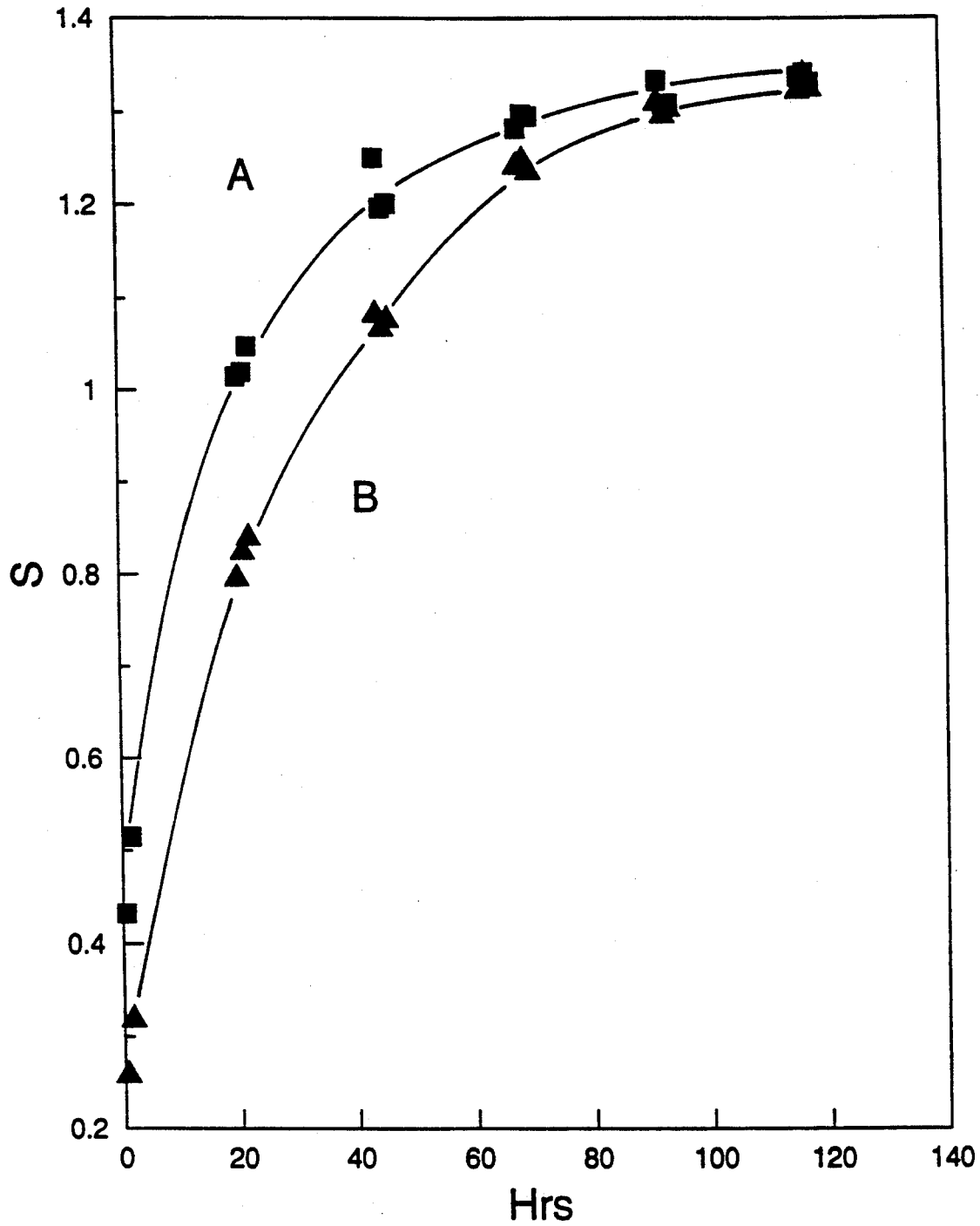
FIG. 4 compares the staged-acidity system of the present invention fluorided-platinum/iridium (0.3% Pt/0.3% Ir/0.6% Cl/0.9% F) in zone 1 and chlorided-platinum/iridium (0.3% Pt/0.3% Ir/0.6% Cl) in zone 2 in a 1:1 ratio designated as (A) with a system where the 2 catalysts are reversed so that the chlorided-Pt/Ir is in zone 1 and the fluorided-Pt/Ir in zone 2 designated as system B. The Y-axis shows the selectivity ratio S=(wt % benzene+wt % toluene)/wt % ($C_1$–$C_6$) and the X-axis time in hours.

FIG. 4 compares the staged-acidity system (A) of the instant invention described in (ii) above where the catalyst in zone 1 is 0.3% Pt/0.3% Ir/0.6% Cl/0.9% F and the catalyst of zone 2 is conventional 0.3% Pt/0.3% Ir/0.9% Cl with a system switching the two catalysts so that zone 1 contains the conventional 0.3% Pt/0.3% Ir/0.9% Cl catalyst and zone 2 contains the 0.3% Pt/0.3% Ir/0.6% Cl/0.9% F catalyst (catalyst System B). The comparison shows that placing the F/Pt/Ir catalyst in the lead-reactor zone (zone 1) provides a more selective system as judged by the (wt % benzene+wt % toluene)/wt % ($C_1$–$C_6$) product ratio than when F/Pt/Ir is placed in the tail-reactor zone (zone 2).

What is claimed is:

1. A staged-acidity reforming process for the increased production of aromatic reformates comprising contacting a naphtha feed under reforming conditions in a plurality of sequentially arranged reaction zones each containing a reforming catalyst wherein said initial reaction zone contains a reforming catalyst having a relative acidity 2–50 fold greater than catalysts of subsequent reaction zones.

2. A staged-acidity reforming process according to claim 1 wherein said reforming catalyst of the initial reaction zone comprises a fluorided-platinum/iridium reforming catalyst.

3. A staged-acidity reforming process according to claim 2 wherein said fluorided-platinum/iridium reforming catalyst has a fluorine content of about 0.1 to 10 wt. %.

4. A staged-acidity reforming process according to claim 2 wherein said fluorided-platinum/iridium reforming catalyst further comprises chlorine.

5. A staged-acidity reforming process according to claim 1 wherein said reforming catalysts in subsequent reaction zones are any conventional reforming catalysts except reforming catalysts having a relative acidity greater than or equal to that of the catalyst in the initial reaction zone.

6. A staged-acidity reforming process according to claim 1 wherein said increased production of aromatic reformates is about 2 to about 20 wt. %.

* * * * *